US008386156B2

(12) United States Patent
Miller

(10) Patent No.: US 8,386,156 B2
(45) Date of Patent: Feb. 26, 2013

(54) SYSTEM AND METHOD FOR LANE-SPECIFIC VEHICLE DETECTION AND CONTROL

(75) Inventor: David Dodd Miller, Austin, TX (US)

(73) Assignee: Siemens Industry, Inc., Alpharetta, GA (US)

( * ) Notice: Subject to any disclaimer, the term of this patent is extended or adjusted under 35 U.S.C. 154(b) by 137 days.

(21) Appl. No.: 12/848,283

(22) Filed: Aug. 2, 2010

(65) Prior Publication Data

US 2012/0029799 A1 Feb. 2, 2012

(51) Int. Cl.
*G08G 1/00* (2006.01)

(52) U.S. Cl. ..... 701/117; 701/118; 701/119; 340/907; 340/910; 340/915; 340/917; 340/924; 340/933; 340/934

(58) Field of Classification Search ..... 701/1, 2, 701/23–28, 116–119; 340/906–943
See application file for complete search history.

(56) References Cited

U.S. PATENT DOCUMENTS

| | | | | |
|---|---|---|---|---|
| 4,884,072 | A * | 11/1989 | Horsch | 340/937 |
| 4,908,615 | A * | 3/1990 | Bayraktaroglu | 340/917 |
| 5,278,554 | A | 1/1994 | Marton | |
| 5,444,442 | A * | 8/1995 | Sadakata et al. | 340/916 |
| 5,528,234 | A * | 6/1996 | Mani et al. | 340/933 |
| 5,539,398 | A | 7/1996 | Hall et al. | |
| 5,617,086 | A * | 4/1997 | Klashinsky et al. | 340/907 |
| 5,917,432 | A * | 6/1999 | Rathbone | 340/907 |
| 5,999,635 | A * | 12/1999 | Higashikubo et al. | 382/104 |
| 6,008,741 | A * | 12/1999 | Shinagawa et al. | 340/907 |
| 6,204,778 | B1 * | 3/2001 | Bergan et al. | 340/936 |
| 6,243,026 | B1 | 6/2001 | Jones et al. | |
| 6,262,673 | B1 | 7/2001 | Kalina | |
| 6,373,402 | B1 * | 4/2002 | Mee | 340/937 |
| 6,417,785 | B1 * | 7/2002 | Tyburski | 340/941 |
| 6,483,443 | B1 * | 11/2002 | Lees et al. | 340/933 |
| 6,587,778 | B2 * | 7/2003 | Stallard et al. | 701/117 |
| 6,633,238 | B2 * | 10/2003 | Lemelson et al. | 340/909 |
| 6,720,920 | B2 | 4/2004 | Breed et al. | |
| 6,760,061 | B1 * | 7/2004 | Glier et al. | 348/149 |
| 6,781,523 | B2 * | 8/2004 | Matsui et al. | 340/910 |
| 6,985,073 | B1 | 1/2006 | Doan | |
| 6,985,827 | B2 * | 1/2006 | Williams et al. | 702/142 |
| 7,327,280 | B2 | 2/2008 | Bachelder et al. | |
| 7,432,827 | B2 * | 10/2008 | Richley | 340/941 |
| 7,817,183 | B2 * | 10/2010 | Pallaro et al. | 348/148 |
| 7,859,431 | B2 * | 12/2010 | Peddie et al. | 340/907 |
| 7,864,072 | B2 * | 1/2011 | Basson et al. | 340/925 |
| 7,924,170 | B1 * | 4/2011 | Arnold et al. | 340/907 |

(Continued)

FOREIGN PATENT DOCUMENTS

| | | |
|---|---|---|
| EP | 1628274 | 5/2005 |
| GB | 2424110 | 9/2006 |

(Continued)

*Primary Examiner* — Jonathan M Dager

(57) ABSTRACT

A roadside equipment (RSE) system that can be used for controlling traffic signals and other equipment and corresponding method. A method includes wirelessly receiving vehicle data from an onboard equipment (OBE) system connected to a vehicle, the vehicle data including location data, time data, and vehicle identification data related to the vehicle. The method includes determining motion data for the vehicle and determining the current state of at least one traffic device. The method includes determining a roadway lane corresponding to the vehicle, based on the motion data and the current state of the at least one traffic device, and storing the vehicle and associated roadway lane.

22 Claims, 3 Drawing Sheets

U.S. PATENT DOCUMENTS

| | | | | |
|---|---|---|---|---|
| 8,031,062 | B2 * | 10/2011 | Smith | 340/438 |
| 8,157,219 | B2 * | 4/2012 | Ashraf et al. | 246/130 |
| 2002/0177942 | A1 * | 11/2002 | Knaian et al. | 701/117 |
| 2004/0056778 | A1 * | 3/2004 | Hilliard | 340/933 |
| 2004/0145496 | A1 * | 7/2004 | Ellis | 340/905 |
| 2004/0222904 | A1 * | 11/2004 | Ciolli | 340/937 |
| 2005/0140523 | A1 | 6/2005 | Publicover | |
| 2005/0174257 | A1 * | 8/2005 | Shankwitz et al. | 340/909 |
| 2006/0155427 | A1 | 7/2006 | Yang | |
| 2006/0181433 | A1 * | 8/2006 | Wolterman | 340/917 |
| 2007/0208495 | A1 * | 9/2007 | Chapman et al. | 701/117 |
| 2008/0162027 | A1 * | 7/2008 | Murphy et al. | 701/117 |
| 2008/0247668 | A1 | 10/2008 | Li et al. | |
| 2008/0260261 | A1 | 10/2008 | Li et al. | |
| 2008/0294401 | A1 | 11/2008 | Tsin et al. | |
| 2009/0109061 | A1 | 4/2009 | McNew et al. | |
| 2009/0167561 | A1 * | 7/2009 | Liang | 340/907 |
| 2009/0174573 | A1 | 7/2009 | Smith | |
| 2009/0296989 | A1 | 12/2009 | Ramesh et al. | |
| 2010/0076621 | A1 * | 3/2010 | Kubotani et al. | 701/1 |
| 2010/0191449 | A1 * | 7/2010 | Iwamoto | 701/118 |
| 2011/0037619 | A1 * | 2/2011 | Ginsberg et al. | 340/910 |

FOREIGN PATENT DOCUMENTS

| | | | |
|---|---|---|---|
| WO | WO 03050779 | A1 | 6/2003 |

* cited by examiner

SYSTEM AND METHOD FOR LANE-SPECIFIC VEHICLE DETECTION AND CONTROL

CROSS-REFERENCE TO OTHER APPLICATION

This application has some subject matter in common with commonly-assigned, concurrently-filed U.S. patent applications 12/848,279, filed Aug. 2, 2010, for "Signal Control Apparatus and Method with Vehicle Detection" and 12/848,286, filed Aug. 2, 2010, for "System and Method for Traffic-Control Phase Change Warnings", both of which are hereby incorporated by reference.

TECHNICAL FIELD

The present disclosure is directed, in general, to improved traffic monitoring and control systems and methods.

BACKGROUND OF THE DISCLOSURE

For reasons related to safety, efficiency, environmental concerns, and other issues, improved traffic control and monitoring systems are desirable.

SUMMARY OF THE DISCLOSURE

Various disclosed embodiments include a roadside equipment (RSE) system that can be used for controlling traffic signals and other equipment and corresponding method. A method includes wirelessly receiving vehicle data from an onboard equipment (OBE) system connected to a vehicle, the vehicle data including location data, time data, and vehicle identification data related to the vehicle. The method includes determining motion data for the vehicle and determining the current state of at least one traffic device. The method includes determining a roadway lane corresponding to the vehicle, based on the motion data and the current state of the at least one traffic device, and storing the vehicle and associated roadway lane.

The foregoing has outlined rather broadly the features and technical advantages of the present disclosure so that those skilled in the art may better understand the detailed description that follows. Additional features and advantages of the disclosure will be described hereinafter that form the subject of the claims. Those skilled in the art will appreciate that they may readily use the conception and the specific embodiment disclosed as a basis for modifying or designing other structures for carrying out the same purposes of the present disclosure. Those skilled in the art will also realize that such equivalent constructions do not depart from the spirit and scope of the disclosure in its broadest form.

Before undertaking the DETAILED DESCRIPTION below, it may be advantageous to set forth definitions of certain words or phrases used throughout this patent document: the terms "include" and "comprise," as well as derivatives thereof, mean inclusion without limitation; the term "or" is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, whether such a device is implemented in hardware, firmware, software or some combination of at least two of the same. It should be noted that the functionality associated with any particular controller may be centralized or distributed, whether locally or remotely. Definitions for certain words and phrases are provided throughout this patent document, and those of ordinary skill in the art will understand that such definitions apply in many, if not most, instances to prior as well as future uses of such defined words and phrases. While some terms may include a wide variety of embodiments, the appended claims may expressly limit these terms to specific embodiments.

BRIEF DESCRIPTION OF THE DRAWINGS

For a more complete understanding of the present disclosure, and the advantages thereof, reference is now made to the following descriptions taken in conjunction with the accompanying drawings, wherein like numbers designate like objects, and in which.

DETAILED DESCRIPTION

Figure 1:
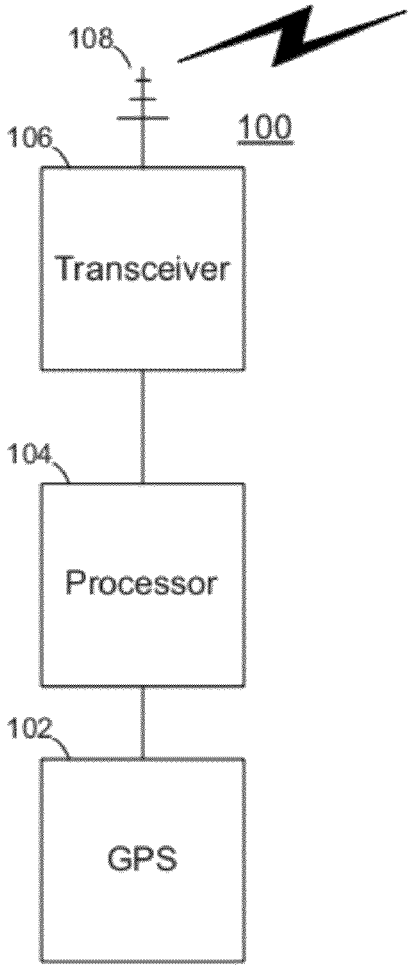
FIG. 1 depicts a simplified block diagram of an onboard equipment system in accordance with disclosed embodiments.

FIGS. 1 through 4, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged device. The numerous innovative teachings of the present application will be described with reference to exemplary non-limiting embodiments.

Efficient traffic management can be accomplished using intelligent traffic control systems that are able to detect vehicles in the area of a traffic control device. Disclosed embodiments include systems and methods in which individual vehicles broadcast information to be received and processed by the traffic control system, which can use the information to determine the specific lanes that each vehicle is using, and control traffic accordingly. Disclosed embodiments provide accurate identification of the roadway lane occupied by each vehicle approaching a traffic signal controller.

When a driver approaches a signalized intersection with multiple phases displayed (such as a GREEN ball and a GREEN arrow), the driver is trained to know which signal to obey, based on the lane occupied by the vehicle. For example, if the driver is approaching in the left turn lane, the driver knows to obey the left turn arrow, not the GREEN ball signal of the through lane. Each signal phase can displayed to the driver for a pre-timed duration, and when a driver approaches an actuated signalized intersection, sensors determine that a vehicle is approaching, via inductive loops cut into the roadway, video detection zones superimposed on roadway lanes, or via a GPS-based system as disclosed herein. The traffic signal controller uses this sensor information to determine which signal to grant the driver, either the GREEN arrow if the vehicle is sensed in the left-turn lane or the GREEN ball if the vehicle is sensed in the through lane.

The related patent application for "Signal Control Apparatus and Method with Vehicle Detection" incorporated herein describes a method whereby roadway lane placement can "learned" by driving a trusted vehicle over the length of each lane approaching a signalized intersection, while periodically recording the position of the trusted vehicle. This data can be recorded, for example, in the traffic signal controller memory such that the GPS location of approaching vehicles can be compared to determine the quantity and velocity of approaching vehicles for efficient control of the traffic signals. Accurate vehicle location is required to insure that each vehicle lane assignment is known.

Accurate lane placement can be achieved by using expensive, highly-accurate GPS equipment in the vehicle, sensors cut in the roadway, or video images susceptible to fog. Other methods include methods to transmit GPS correction information from the roadside to the vehicle's less-accurate and less-expensive GPS equipment.

As described in a related patent application referenced above and incorporated herein, the systems and methods disclosed herein include various means of using onboard equipment (OBE) installed or used in a vehicle and roadside equipment (RSE) that detects the vehicle by communicating with the OBE. Of course, in various embodiments, some or all of the components of the RSE could be physically located other than "roadside", such as in a cabinet, traffic controller, signal head, or otherwise. The RSE can be used to control many different types of traffic equipments, and can be used to collect and send data to a central monitoring station for further analysis or action, using common networking and communication techniques.

For the onboard equipment, global positioning system (GPS) and radio technology can be used. By processing the signals received from several satellites, a GPS receiver accurately and precisely computes latitude and longitude, such as within 3 feet of error.

Disclosed embodiments include an RSE system and method that enables lane-specific identification of vehicles by comparing the location and movement of each vehicle with the phase of the traffic signal controlled by the RSE. These processes are useful where the operation of the traffic controller, or communications with vehicles, may be modified based on the lane-specific location of one or more vehicles.

In some vehicles, the installed GPS units do not provide enough accuracy to locate vehicles within a specific lane. The disclosed embodiments address this problem by comparing the GPS information received from each vehicle to the signal phases visible to the driver.

FIG. 1 depicts a simplified block diagram of an onboard equipment system 100 in accordance with disclosed embodiments. In this diagram, processor 104 is connected between a GPS receiver 102 and a transceiver 106, such that the processor 104 receives the geographic location of the GPS receiver 102 and precise time of day, updated continually or periodically. The GPS receiver 102 receives the geographic location and time from the GPS and then sends it to the processor 104, along with a vehicle identification. The processor 104 then sends the geographic location and time to the transceiver 106, which transmits it via antenna 108 to the RSE.

In this manner, the RSE receives continuous updates of the geographic location at a precise time for every vehicle approaching from each direction that is within the broadcast area of the respective transceivers 106.

Those of skill in the art will recognize that not all other details are shown in this simplified diagram. For example, GPS receiver 102 may also be connected to an automobile navigation system, an emergency-communication system, or to other components of the automobile. The GPS receiver 102, processor 104, and transceiver 106 will each also be connected to a vehicle power source, and may each be connected to other systems and components of the vehicle. The processor 104, and other components, can be connected to read and write to a storage such as volatile and non-volatile memory, magnetic, optical, or solid-state media, or other storage devices. The antenna 108 may be dedicated to transceiver 106, or may be connected to be shared with other components. Transceiver 106 itself can be only a wireless transmitter, although of course it receives data from the processor 104, or can also be a wireless receiver. Processor 104 may be configured to perform only the processes described herein, or can also be configured to perform other processes for the operation and management the vehicle. The various components of FIG. 1 could be constructed as separate elements connected to communicate with each other, or two or more of these components could be integrated into a single device.

Figure 2:
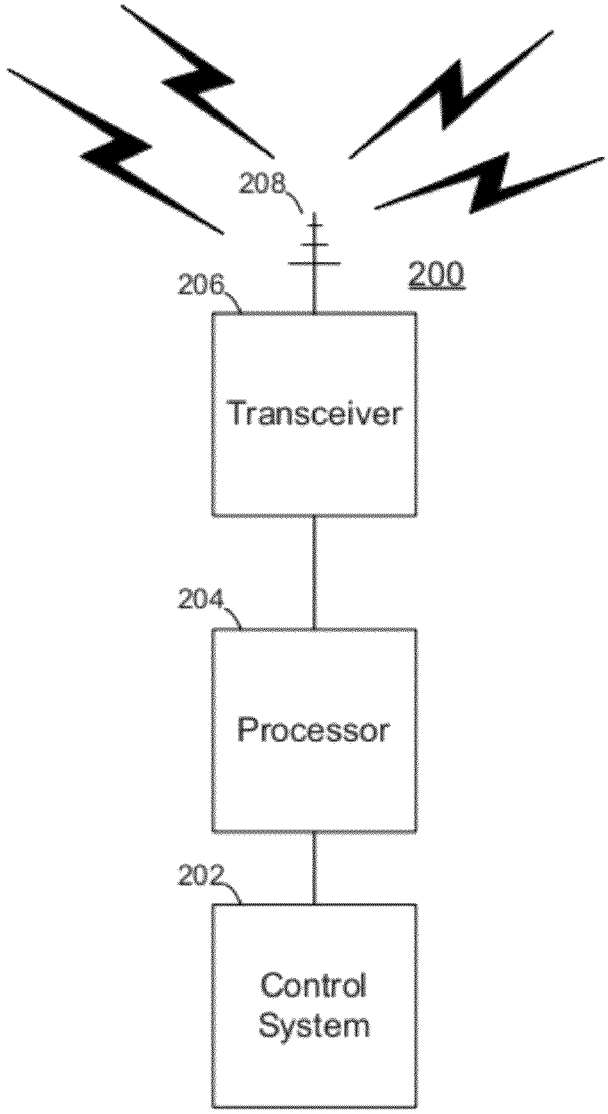
FIG. 2 depicts simplified block diagram of a roadside equipment system in accordance with disclosed embodiments.

FIG. 2 depicts a simplified block diagram of a roadside equipment system 200, in accordance with disclosed embodiments, that can be configured to perform processes as described herein. In this diagram, processor 204 is connected between a control system 202 and a transceiver 206. The transceiver 206 receives the geographic location, time information, and vehicle identification data from multiple OBE transceivers 106 that includes the location data and corresponding time data for multiple uniquely-identified vehicles, updated continually or periodically. The transceiver 206 receives this data from the vehicles and then sends it to the processor 204. The processor 204 then sends the geographic location and time to the control system 202, which can use it for traffic control and management processes, as described in more detail herein. Control system 202 can be a signal controller, or a traffic signal with integrated controller, or other system configured to control traffic equipment.

Those of skill in the art will recognize that not all other details are shown in this simplified diagram. For example, control system 202, processor 204, and transceiver 206 will each also be connected to a power source, and may each be connected to other systems and components of the RSE. The processor 204, and other components, can be connected to read and write to a storage such as volatile and non-volatile memory, magnetic, optical, or solid-state media, or other storage devices. The antenna 208 may be dedicated to transceiver 206, or may be connected to be shared with other components. Transceiver 206 itself can be only a wireless receiver, although of course it transmits data to the processor 204, or can also be a wireless transmitter. Processor 204 may be configured to perform only the processes described herein, or can also be configured to perform other processes for the operation and management the RSE. The various components of FIG. 2 could be constructed as separate elements connected to communicate with each other, or two or more of these components could be integrated into a single device. In particular, processor 204 can be an integral part of the control system 202, and perform many or all of the other functions of the RSE.

The incorporated related applications describe processes for commissioning and operating such a GPS-enabled traffic control system. Commissioning includes setting up the RSE and using a vehicle with the disclosed OBE to define the detection zones for each of the roads, and lanes of those roads, of interest. Operation can include detecting the vehicles, by the RSE receiving the vehicle data from the OBE, determining if the vehicle is in a detection zone, and producing a control signal, such as to control a traffic signal.

Figure 3:
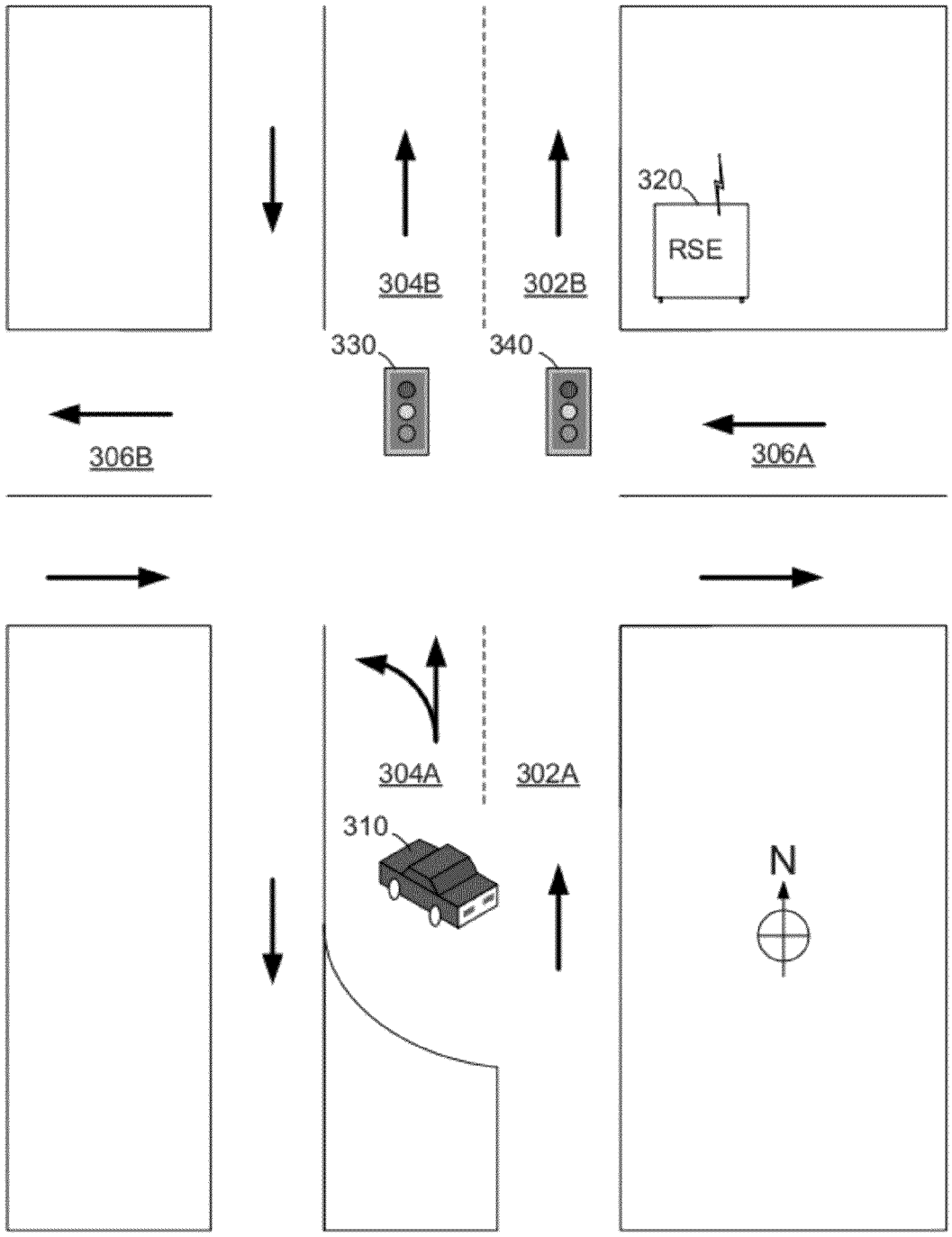
FIG. 3 depicts an example intersection that can illustrate disclosed embodiments.

FIG. 3 depicts an example intersection that can illustrate disclosed embodiments. FIG. 3 shows an intersection of two multi-lane roads, including northbound lanes 302A/B and 304A/B, and westbound lane 306A/B. Vehicle 310, which include OBE described above, is shown in land 304A, and can travel either straight through the intersection to lane 304B, or can turn left at the intersection to lane 306B.

The OBE of vehicle 310 communicates with RSE 320, as described herein. RSE 320, among other functions, controls traffic equipment such as traffic signals 330 and 340. Traffic signal 340 governs northbound lane 302A, and traffic signal 330 governs northbound lane 304A. For the purposes of this example, assume that each of these traffic signals includes at least the standard RED, YELLOW, and GREEN ball indicators, and traffic signal 330 also includes at least a left-turn indicator for traffic turning from lane 304A to lane 306B. The different states of the lights on the traffic signals is referred to herein as the traffic signal "phase", since the signals generally cycle in a regular order. Of course, in other implementations, and certainly in other jurisdictions, the signal operations and indicators may differ in color, placement, operations, or otherwise. Likewise, an intersection such as that depicted in this example would typically have other traffic equipment and signals also operating.

In this example, RSE 320 can manage traffic signals 330 and 340 according to the vehicle data, including location data, time data, and vehicle identification data, that is received from vehicle 310 and other vehicles. In this example, assume that the "detection zones" for RSE 320 includes in the portions of the intersecting streets shown in FIG. 3. When the RSE 320 determines, from the received vehicle data, that the vehicle is present in a detection zone, the RSE determines the location and direction of travel of the vehicle, and can then control the traffic signals accordingly, to ensure safe and efficient travel.

If the OBE in vehicle 310 is not sufficiently accurate, RSE 320 may not be able to determine if vehicle 310 is in lane 302A, 304A, or the adjoining southbound lane, or the similar locations of other vehicles. Of course, by determining the northbound direction of travel of vehicle 310, the RSE 320 may assume that the vehicle is in a northbound lane. Without such accuracy, the RCE is less effective at managing the traffic signals 330 and 340 than it might otherwise be. Disclosed embodiments enable the RSE to determine the lane of travel more specifically based on both the vehicle data and the phase of the signals themselves.

For example, assume that the GPS location of the lane 304A detection zone is known to the RSE 320. Approaching vehicles transmit their GPS location as part of the vehicle data, with some vehicles transmitting from the left-turn lane 304A, and other vehicles transmitting from the through lane 302A.

The RSE 320 traffic signal controller changes the left-turn arrow of traffic signal 330 to GREEN for lane 304A, while keeping traffic signal 340 showing RED to lane 302A. The vehicles in the left-turn lane 304A, such as vehicle 310, begin to move through the intersection and turn left, while the vehicles in through lane 302A do not move, since that light is RED.

By analyzing the vehicle data received from the vehicles, and identifying the number of changing GPS positions, RSE 320 can determine the number and identity of vehicles occupying the left-turn lane 304A. By identifying the number of stationary GPS positions, RSE 320 can determine the number of vehicles occupying the through lane 302A.

Using this information, the RSE 320 can efficiently control the approaching traffic by knowing the location, velocity and destination of each approaching vehicle. Also, this information can be used to identify "incidents" by noting abnormal traffic movements to signal phases, such as stalled cars or red-light runners, where vehicles are moving (or stationary) at a location that is inconsistent with the phase of the traffic signal.

Figure 4:
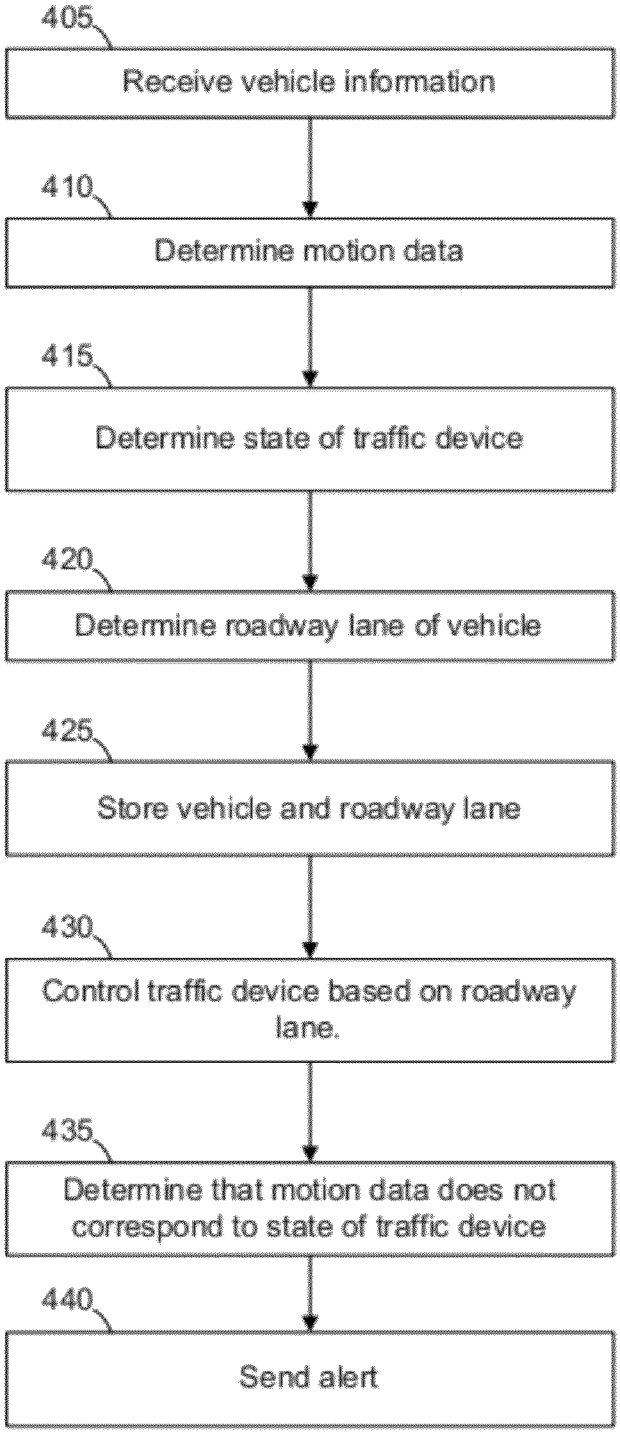
FIG. 4 depicts a process in accordance with disclosed embodiments.

FIG. 4 depicts a flowchart of a process in accordance with disclosed embodiments. The RSE steps described below can be performed by processor 204, in various embodiments.

The RSE receives vehicle data including location data from OBE of at least one vehicle (step 405).

The RSE determines motion data for the at least one vehicle (step 410). The motion data can include current direction and speed data, including that the vehicle is not currently moving. The motion data can be determined by comparing successive location data corresponding to each of the vehicles, or can be determined by directly receiving motion data from the vehicles as part of the vehicle data.

The RSE determines the current state of at least one traffic device or other traffic equipment (step 415). The traffic device can be but is not limited to a traffic signal, and the current state can include the current phase of the traffic signal in a direction corresponding to the location data of the vehicles. The traffic device, or the state of the traffic device, can be associated with a specific roadway lane.

Based on the motion data of the at least one vehicle and the current state of the at least one traffic device, the RSE determines a roadway lane corresponding to the vehicles (step 420). As described herein, this can be accomplished by determining which lane or lanes of traffic should be moving based on the current state of the traffic device, e.g., a GREEN light, and determining that the vehicles with the expected motion data are in that lane. Similarly, if the current state of the traffic device indicates that the traffic should not be moving, e.g., a RED light, then the RSE determines that vehicles with motion data indicating that they are substantially stationary are in that lane.

The RSE stores the vehicles as associated with the determined roadway lane (step 425). This can be stored in the memory of the RSE.

The RSE can optionally control the at least one traffic device based on the determined roadway lane (step 430). This can be accomplished by sending a control signal from the processor 204 to the control system 202, for example, where the control system 202 is the traffic device or controls the traffic device. This step can also be based on other factors, such as the motion or location data.

The RSE can optionally also detect when the motion data for the at least one vehicle does not correspond to the state of the traffic device (step 435), indicating a traffic anomaly or problem situation, and send an alert to a monitoring system (step 440). The monitoring system can be a centralized traffic control system, for example.

The process above can be performed repeatedly and simultaneously for a plurality of vehicles and a plurality of traffic devices, to constantly assign roadway lanes to multiple vehicles. The system can also accumulate traffic data, such as the number of vehicles traveling in each lane, based on the vehicles (or vehicle data) and associated roadway lanes.

Disclosed embodiments provide distinct technical advantages in traffic control, since the GPS location of each vehicle does not need to be accurate down to the width of the lane. The vehicle simply provides its vehicle data, which can include is reasonably accurate location to the signal controller and/or GPS approach direction, and the RSE can correlate the speed of each vehicle to the corresponding signal phases to determine how many vehicles are queued for each phase. Based on this information, the signal controller can optimize the times for each phase without sensors in the roadway and without requiring extremely accurate vehicle location within the lane.

In various embodiments, roadside equipment system 200 can use processor 204 to automatically self-learn the location and geometry of roadway lanes based on a historic correlation of vehicle movements to signal phase changes. The movements of a large number of vehicles are recorded in response to signal changes and recorded by processor 204. From this data, a high-quality estimate of lane locations can be made by including a large number of repetitive movements within a lane geometry and by excluding inconclusive movements such as stalled vehicles and vehicles straddling lanes. This is provides a distinct technical advantage over processes that involve performing a site survey of lane locations and geometry, then entering the lane location information into processor 204. This self-learning method can be used in addition to or as a replacement for the process described in the incorporated patent application that uses a vehicle with "trusted" OBE.

Those skilled in the art will recognize that, for simplicity and clarity, the full structure and operation of all systems suitable for use with the present disclosure is not being depicted or described herein. Instead, only so much of an OBE and RSE system as is unique to the present disclosure or necessary for an understanding of the present disclosure is depicted and described. The remainder of the construction and operation of the systems disclosed herein may conform to any of the various current implementations and practices known in the art.

It is important to note that while the disclosure includes a description in the context of a fully functional system, those skilled in the art will appreciate that at least portions of the mechanism of the present disclosure are capable of being distributed in the form of a instructions contained within a machine-usable, computer-usable, or computer-readable medium in any of a variety of forms, and that the present disclosure applies equally regardless of the particular type of instruction or signal bearing medium or storage medium utilized to actually carry out the distribution. Examples of machine usable/readable or computer usable/readable mediums include: nonvolatile, hard-coded type mediums such as read only memories (ROMs) or erasable, electrically programmable read only memories (EEPROMs), and user-recordable type mediums such as floppy disks, hard disk drives and compact disk read only memories (CD-ROMs) or digital versatile disks (DVDs).

Although an exemplary embodiment of the present disclosure has been described in detail, those skilled in the art will understand that various changes, substitutions, variations, and improvements disclosed herein may be made without departing from the spirit and scope of the disclosure in its broadest form. For example, signal phase and timing information can be transmitted from processor 204 to processor 104 via transceivers 106 and 206. This signal phase and timing information can be used to display a graphical representation of the roadside traffic signal on the navigation screen of the vehicle, including during conditions of low visibility such as fog or snow covering the traffic signal lenses. By enabling the driver to respond to the in-vehicle signal identically as she would to the roadside signal, such an embodiment allows the driver to observer and obey traffic signals as displayed in vehicle even when the signals are not directly visible.

None of the description in the present application should be read as implying that any particular element, step, or function is an essential element which must be included in the claim scope: the scope of patented subject matter is defined only by the allowed claims. Moreover, none of these claims are intended to invoke paragraph six of 35 USC §112 unless the exact words "means for" are followed by a participle.

What is claimed is:

1. A method for vehicle detection, comprising:

wirelessly receiving vehicle data by a roadside equipment (RSE) system and from an onboard equipment (OBE) system connected to a vehicle, the vehicle data including location data, time data, and vehicle identification data related to the vehicle;

determining motion data for the vehicle by the RSE;

determining the current state of at least one traffic signal;

determining, by the RSE, a roadway lane corresponding to the vehicle, based on the motion data and the current state of the at least one traffic signal;

and storing the vehicle and associated roadway lane in the RSE.

2. The method of claim 1, wherein the motion data is determined by the RSE from the received vehicle data.

3. The method of claim 1, wherein the current state of the at least one traffic signal is associated with the roadway lane.

4. The method of claim 1, wherein the state of the at least one traffic signal is the phase of the traffic signal in a direction corresponding to the location data.

5. The method of claim 1, wherein the RSE controls the at least one traffic signal based on the vehicle and associated roadway lane.

6. The method of claim 1, wherein the method is performed repeatedly and simultaneously for a plurality of vehicles and a plurality of traffic signals.

7. The method of claim 1, wherein the RSE accumulates traffic data, including a number of vehicles traveling in each of a plurality of roadway lanes, based on the vehicle data and associated roadway lane.

8. The method of claim 1, wherein the RSE detects that the motion data does not correspond to the current state of the traffic signal.

9. The method of claim 1, wherein the RSE detects that the motion data does not correspond to the current state of the traffic signal and thereafter sends an alert to a monitoring system.

10. The method of claim 1, wherein the motion data is wirelessly received as part of the vehicle data.

11. The method of claim 1, wherein the RSE system accumulates traffic data and uses the accumulated traffic data to define a plurality of roadway lanes.

12. A roadside equipment (RSE) system comprising at least a processor and a wireless receiver, the RSE system configured to perform the steps of:

wirelessly receiving vehicle data from an onboard equipment (OBE) system connected to a vehicle, the vehicle data including location data, time data, and vehicle identification data related to the vehicle;

determining motion data for the vehicle;

determining the current state of at least one traffic signal;

determining a roadway lane corresponding to the vehicle, based on the motion data and the current state of the at least one traffic device; and storing the vehicle and associated roadway lane.

13. The RSE system of claim 12, wherein the motion data is determined by the RSE from the received vehicle data.

14. The RSE system of claim 12, wherein the current state of the at least one traffic signal is associated with the roadway lane.

15. The RSE system of claim 12, wherein the state of the at least one traffic device is the phase of the traffic signal in a direction corresponding to the location data.

16. The RSE system of claim 12, wherein the RSE controls the at least one traffic signal based on the vehicle and associated roadway lane.

17. The RSE system of claim 12, wherein the method is performed repeatedly and simultaneously for a plurality of vehicles and a plurality of traffic signals.

18. The RSE system of claim 12, wherein the RSE accumulates traffic data, including a number of vehicles traveling in each of a plurality of roadway lanes, based on the vehicle data and associated roadway lane.

19. The RSE system of claim 12, wherein the RSE detects that the motion data does not correspond to the current state of the traffic signal.

20. The RSE system of claim 12, wherein the RSE detects that the motion data does not correspond to the current state of the traffic signal and thereafter sends an alert to a monitoring system.

21. The RSE system of claim 12, wherein the motion data is wirelessly received as part of the vehicle data.

22. The RSE system of claim 12, wherein the RSE system accumulates traffic data and uses the accumulated traffic data to define a plurality of roadway lanes.

* * * * *